United States Patent [19]

Simon

[11] Patent Number: 4,917,270

[45] Date of Patent: Apr. 17, 1990

[54] CLOSURE DEVICE WITH POURING NOZZLE AND POURING SPOUT METERING STOPPER

[75] Inventor: Patrick Simon, Gautier, France

[73] Assignee: Societe de Conseils et D'Etudes des Emballages S.C.E.E., Seine et Marne, France

[21] Appl. No.: 214,552

[22] Filed: Jun. 29, 1988

[30] Foreign Application Priority Data

Jun. 29, 1987 [FR] France ..... 87 09145

[51] Int. Cl.[4] ..... B67D 1/16

[52] U.S. Cl. ..... 222/111; 222/153; 215/256

[58] Field of Search ..... 222/111, 109, 108, 562, 222/570, 568; 215/228, 256, 250, 253

[56] References Cited

U.S. PATENT DOCUMENTS

| | | | |
|---|---|---|---|
| 2,763,403 | 9/1956 | Livingstone | 222/111 |
| 4,127,221 | 11/1978 | Vere | 222/153 |
| 4,696,416 | 9/1987 | Marchenfuhs et al. | 222/109 |
| 4,760,941 | 8/1988 | Salmon et al. | 222/153 |
| 4,773,560 | 9/1988 | Kittscher | 222/109 |

*Primary Examiner*—Kevin P. Shaver
*Assistant Examiner*—Kenneth Noland
*Attorney, Agent, or Firm*—Browdy and Neimark

[57] ABSTRACT

In a closure device with pouring nozzle and metering stopper, the pouring nozzle is formed of a pouring spout of closed periphery, extending partly inside a sheath and protruding beyond the sheath. The sheath is in turn extended by a rotating ring provided for its fixation and orientation on end of a neck of the container and having its outer wall serving for retaining a skirt formed about a lower portion of a body of the metering stopper with a pouring spout forming a cover and covering the pouring spout of the pouting nozzle.

13 Claims, 2 Drawing Sheets

CLOSURE DEVICE WITH POURING NOZZLE AND POURING SPOUT METERING STOPPER

BACKGROUND OF THE INVENTION

This invention relates to closure devices for various containers, in particular for flasks of the type of those used for containing household products, food products or cosmetics.

Pouring stoppers are known in the art which are fixed to the neck of a container, the portion forming the pouring spout ending in a bevel. This pouring spout portion is normally covered by a cap which can be fixed to the container.

The known closure devices have several disadvantages. Quite often, their pouring spout portion is open at the top so that there are sometimes overflows, particularly when air finds some difficulty in entering the container, thereby causing a jerky outflow.

Known pouring spout does not include an orientation system permitting to the end of the pouring spout to be perfectly in axis of the handle of the container, this being detrimental to handling ease.

On the other hand, when the cap is intended for being used as a metering stopper, it is very difficult to pour-out the product contained in the metering stopper in an opening of small dimension, such as is the case for example for filling-up with softening products a suitable recess provided in washing machines.

OBJECT OF THE INVENTION

The invention provides a new closure device with pouring nozzle and pouring spout metering stopper which remedies the hereabove disadvantages.

SUMMARY OF THE INVENTION

According to the invention, in a closure device with pouring nozzle and metering stopper for a container, the pouring nozzle is formed of a pouring spout of closed periphery, extending partly inside a sheath and protruding beyond this sheath, the sheath being in turn extended by a rotating ring provided for fixation and orientation of the sheath on end of a neck of the container and having an outer wall serving for retaining a skirt formed about a lower portion of a body of the metering stopper with a pouring spout forming a cover and covering the pouring spout of the pouring nozzle.

Various other features of the invention will become more apparent from the hereafter detailed description.

BRIEF DESCRIPTION OF THE DRAWINGS

Embodiments of the invention are shown by way of non limiting examples in the accompanying drawings, wherein.

DETAILED DESCRIPTION OF THE INVENTION

Figure 1:
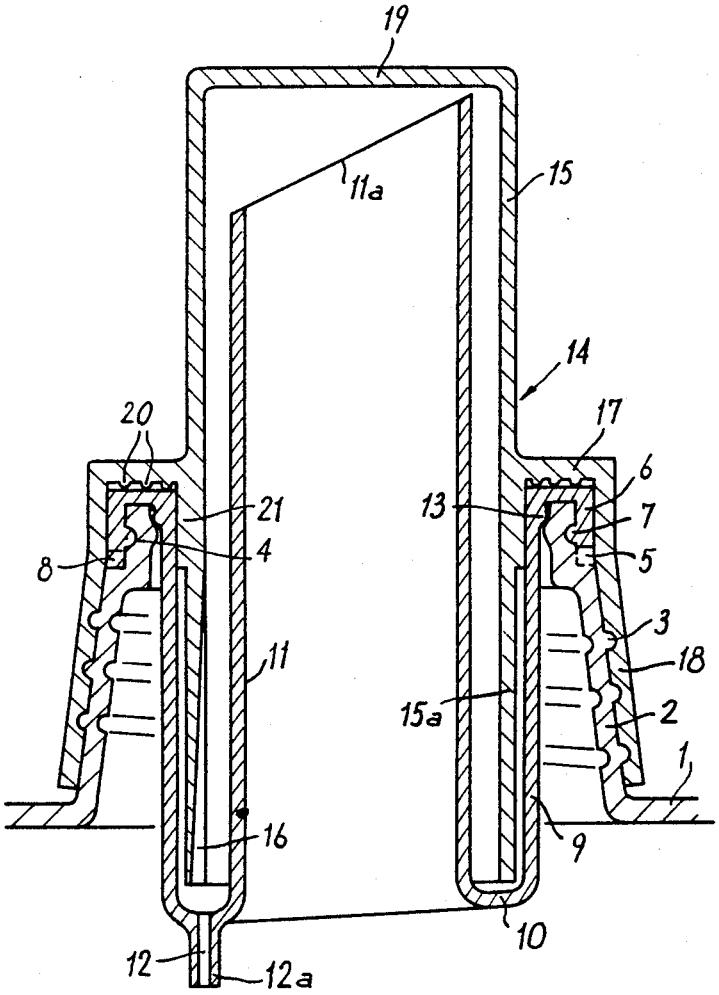
FIG. 1 is an elevation cross-sectional view of the closure device with pouring nozzle and pouring spout metering stopper of the invention.

Referring now to the drawings, a container such as a flask is designated by reference numeral 1. The flask 1 includes a neck 2, for example of a frustoconical shape and which includes protuberances 3 preferably defining a threading.

At its upper portion, the neck 2 defines a groove 4 and, below the groove 4, a serrated crown 5.

The top of the neck 2 is nested inside a ring 6 forming a bead 7 entering the groove 4 and teeth 8 cooperating with the serrated crown 5.

The inner side of the ring 6 is extended by a sheath 9 having a slanting bottom part 10 from which is formed a pouring spout 11 closed on its periphery which ends well above the ring 6 advantageously in a bevel 11*a*. The downmost portion of the slanting bottom part 10 is formed with an opening 12 of small diameter calibrated to the liquid to be contained as explained below.

The pouring spout 11 can be indifferently of an annular or ovoidal cross-section.

It is advantageous that the sheath 9 is formed, at its upper portion, with a protruding bulge 13 or lip, which is pressed against an inner wall of the neck 2 when the bulge 7 of the ring 6 is engaged into the groove 4.

The hereabove description shows that, for positioning the pouring spout 11, it suffices to engage the pouring spout 11 via its sheath 9 into the neck 2 and to exert a sufficient pressure so that the bulge 7 will enter, by a resilient deformation of the ring 6, into the groove 4 while the protruding bulge 13 is pressed against the inner wall of the neck 2. It is rapid fixation of the pouring spout 11 is thus ensured, as well as its tightness and orientation of the spout 11 with respect to the flask 1.

A metering stopper 14 having a pouring spout 16 forms a cover for the pouring nozzle and includes to this end a body 15 extended by a skirt 15*a* which is inserted between the sheath 9 and the pouring spout 11.

The skirt 15*a* defines in turn the pouring spout 16. In order to permit its fixation, the pouring spout metering stopper 14 defines a shoulder 17 from which extends a skirt 18 having a shape mating that of the outer wall of the neck 2. In the example shown, the skirt 18 is consequently of a frustoconical shape and is formed with an inner threading corresponding to the threading 3 defined by the protuberances of the neck 2.

The frustoconical shape imparted to the neck 2 and skirt 18 makes easy the positioning and removal of the pouring spout metering stopper 14 which can thus be either screwed or snapped-in by a resilient deformation, by exerting a simple push on its bottom part 19. It should be noted that this frustoconical shape enables obtaining by moulding a threading in the skirt 18, removal from the mould being simply a tearing out operation, thereby substantially increasing the moulding rates.

In order to provide a good tightness between the pouring nozzle and the pouring spout metering stopper, it is advantageous that the underneath portion of the shoulder 17 is formed with annular ribs 20 bearing on top of the ring 6.

Figure 6:
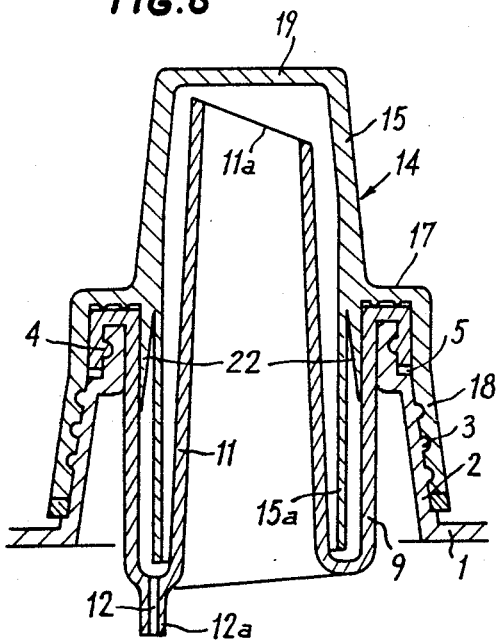
FIG. 6 is an elevation cross-sectional view similar to FIG. 1 of an alternative embodiment.
Figure 2:
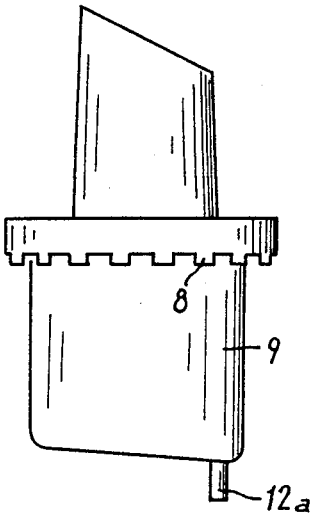
FIG. 2 is an elevation view of the pouring nozzle, shown separately.

On the other hand, a portion of greater thickness 21 (FIG. 1) or a deformable lip 22 (FIG. 6) is provided so as to protrude from the skirt 15*a* and thus to bear against the inner wall of the sheath 9.

For facilitating the use of the pouring spout metering stopper 14, the skirt 15*a* which forms the pouring spout 16 is provided in such a manner as to substantially protrude with respect to the skirt 18 intended for cooperating with the neck 2.

Figure 4:
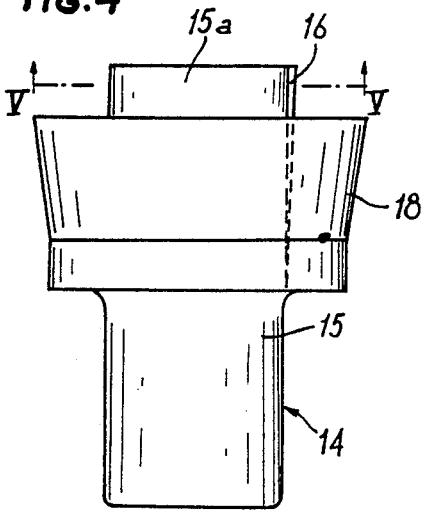
FIG. 4 is an elevation view of the pouring spout metering stopper in a turned-over position ready for use.
Figure 3:
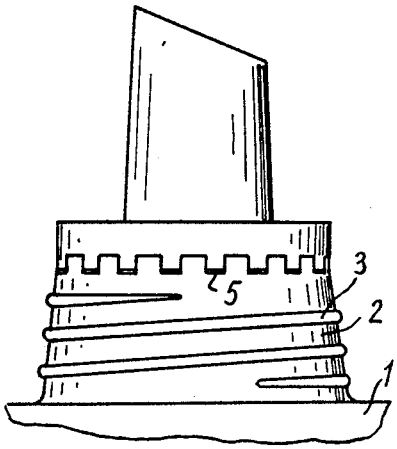
FIG. 3 is an elevation view similar to FIG. 2 of the pouring nozzle positioned on a flask.
Figure 5:
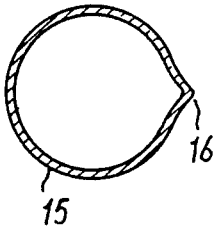
FIG. 5 is a cross-sectional view taken along line V—V of FIG. 4 and showing the shape of the pouring spout.

As is apparent from the foregoing disclosure, when one wishes to use a dose of the product contained in the flask 1, the pouring spout metering stopper 14 is removed by being unscrewed and is turned over so as to occupy the position illustrated in FIG. 4.

A part of the product contained in the flask 1 is then poured via the pouring spout 11 until it fills the pouring spout metering stopper 14 in or until the poured-out product comes in register with one of several marks which can be provided inside and/or outside the pouring spout metering stopper 14.

The product thus brought in the pouring spout metering stopper 14 is then in turn poured-out at the point of use, which is facilitated by the pouring spout 16.

The pouring spout metering stopper 14 is then put back in position. If traces of the product it contained will remain in the pouring spout metering stopper 14, these traces will flow-down in the slanting gutter formed by the bottom part 10 of the pouring nozzle and, consequently, these product traces can flow-back through the opening 12 inside the flask 1. The opening 12 may take the form of a small tube 12*a* as illustrated.

The opening 12 has also as a function to enable air to flow inside the flask 1 when product it contains is poured-out via the pouring spout 11. It will be understood that for low viscosity liquids, the opening 12 need be only very small to provide both adequate air relief during pouring and flow-back of excess liquid thereafter.

For providing a good tightness and facilitating the handling, it is advantageous that the pouring spout be made of a material such as polyethylene of lesser hardness than that of the material forming the pouring spout metering stopper, which can be moulded for example in polypropylene.

The invention is not limited to the embodiments shown and described in detail and various modifications thereof can be carried out thereto without departing from its scope as shown in the claims. In particular, the serrated crown 5 could be omitted and, in such a case, the groove 4 could be formed by a succession of small recesses, while the bead 7 would be replaced by small protuberances corresponding to these recesses. The serrated crown or the hereabove recesses are intended for enabling a setting in position of the pouring spout 11 with respect to the flask 1. When the setting in position and the securing against motion in the chosen position are not necessary, it is also possible to omit completely the serrated crow 5, the teeth 8 or the recesses and protrusions used instead ; in this case, the pouring spout can rotate freely with respect to the flask and can therefore also be brought to the position desired by the user.

What is claimed is:

1. In a closure device with a pouring nozzle and metering stopper for a container, the pouring nozzle being formed of a pouring spout (11) of closed periphery having a beveled open end (11*a*), extending partly inside a sheath (9) having an upper end, the sheath (9) being extended at its upper end by a rotating ring (6) provided for fixation and orientation of the sheath on an upper end of a neck (2) of the container (1) and having an outer wall serving for retaining a skirt (18) formed about a lower portion of a body (15) of the metering stopper (14) with a pouring spout (16) forming a cover and covering he pouring spout (11) of the pouring nozzle, said beveled open end (11*a*) having a periphery extending entirely above said ring (6), and wherein the sheath (9) of the pouring nozzle is extended by a slanting bottom part (10) leading to the pouring spout (11), said slanting bottom part (10) being formed with a small opening (12), calibrated as a function of a product contained, in its lowermost portion in order to obtain an inflow of air for pouring-out the product and a reintroduction of the product inside the container when the metering stopper is screwed again on the pouring nozzle closure device, wherein said ring (6) forms teeth (8) cooperating with a serrated crown (5) of the neck (2).

2. The closure device with pouring nozzle and metering stopper as set forth in claim 1, wherein the pouring spout (16) is formed by a skirt (15*a*) extending the metering stopper (14).

3. The closure device with pouring nozzle and metering stopper as set forth in claim 1, wherein the ring (6) of the pouring nozzle (11) forms nesting, latching and orientation means cooperating with the neck (2).

4. The closure device with pouring nozzle and metering stopper as set forth in claim 1, wherein the ring (6) forms bead-shaped protrusions engaged in recesses or grooves (4) of the neck (2).

5. The closure device with pouring nozzle and metering stopper as set forth in claim 1, wherein the ring (6) forms a protruding bead (13) pressed against inner wall of the neck (2).

6. The closure device with pouring nozzle and metering stopper as set forth in claim 1, wherein the ring (6) has a top portion, said top portion forming a bearing surface for sealing ribs (20) formed on the metering stopper (14).

7. The closure device with pouring nozzle and metering stopper as set forth in claim 1, wherein the pouring spout metering stopper (14) is fixed on the neck (2) of the container via a frustoconical-shaped skirt (18) having protuberances corresponding to protuberances of the neck (2).

8. The closure device with pouring nozzle and metering stopper as set forth in claim 1, wherein the pouring nozzle is made by moulding from a material more flexible than a constituent material of the pouring spout metering stopper made by moulding, association of said materials ensuring a perfect tightness.

9. The closure device with pouring nozzle and metering stopper as set forth in claim 1, comprising an over thickness or lip (21, 22) for providing a suitable tightness between the pouring spout and the pouring spout metering stopper.

10. The closure device with pouring nozzle and metering stopper as set forth in claim 7, wherein said protuberances are in the shape of threadings.

11. The closure device with pouring nozzle and metering stopper as set forth in claim 8, wherein the pouring nozzle is made of polyethylene.

12. The closure device with pouring nozzle and metering stopper as set forth in claim 8, wherein the pouring spout metering stopper is made of polypropylene.

13. The closure device according to claim 1, wherein said small opening (12) comprises a downwardly extending tube (12*a*).

* * * * *